US009885499B2

(12) United States Patent
Giampiccolo

(10) Patent No.: US 9,885,499 B2
(45) Date of Patent: Feb. 6, 2018

(54) REFRIGERANT AIR CONDITIONER FOR BOATS IN PORTS AND MARINAS

(71) Applicant: Marcello Giampiccolo, Pornassio (IT)

(72) Inventor: Marcello Giampiccolo, Pornassio (IT)

( * ) Notice: Subject to any disclaimer, the term of this patent is extended or adjusted under 35 U.S.C. 154(b) by 0 days.

(21) Appl. No.: 14/962,567

(22) Filed: Dec. 8, 2015

(65) Prior Publication Data

US 2016/0169561 A1 Jun. 16, 2016

(30) Foreign Application Priority Data

Dec. 10, 2014 (IT) ..... RM2014A0713

(51) Int. Cl.

| | |
|---|---|
| ***F25B 13/00*** | (2006.01) |
| ***F24F 1/00*** | (2011.01) |
| ***F24F 1/14*** | (2011.01) |
| ***F24F 1/60*** | (2011.01) |
| *B63J 3/04* | (2006.01) |

(52) U.S. Cl.

CPC ..... *F25B 13/00* (2013.01); *F24F 1/0003* (2013.01); *F24F 1/14* (2013.01); *F24F 1/60* (2013.01); *B63J 2003/043* (2013.01)

(58) Field of Classification Search

CPC .... F24F 1/14; F24F 1/60; F24F 1/0003; B63J 2/04; B63J 2003/043

USPC ..... 62/428

See application file for complete search history.

(56) References Cited

U.S. PATENT DOCUMENTS

| | | | | |
|---|---|---|---|---|
| 2,708,835 | A * | 5/1955 | Nigro | F24F 1/0003 261/101 |
| 3,740,964 | A * | 6/1973 | Herweg | F24F 1/0003 62/262 |
| 3,760,601 | A | 9/1973 | Bunten | |
| 3,888,090 | A | 6/1975 | Meyer | |
| 4,873,600 | A | 10/1989 | Vogele | |
| 2006/0076835 | A1* | 4/2006 | Slocum | B63J 3/04 307/29 |
| 2010/0229585 | A1* | 9/2010 | Bradford | F24F 1/0003 62/291 |

FOREIGN PATENT DOCUMENTS

| | | |
|---|---|---|
| EP | 3 695 917 A2 | 2/1996 |
| EP | 1 955 946 A2 | 8/2008 |
| WO | 2014/199250 A1 | 12/2014 |

OTHER PUBLICATIONS

IT Search Report, dated Aug. 3, 2015, from corresponding IT application.

* cited by examiner

*Primary Examiner* — Mohammad M Ali
(74) *Attorney, Agent, or Firm* — Young & Thompson

(57) ABSTRACT

A refrigerant air conditioner for boats in ports and marinas, comprising a compressor (1), an external heat exchanger, an internal heat exchanger (13) cooperating with a fan (12). The compressor (1) and the external heat exchanger are contained within an air conditioner container (16; 38) forming part of a multi-service pedestal (17; 36), equipped with a support structure (20; 37) situated on a pier (P) or quay, and the room heat exchanger (13) is placed in a boat (B) moored to pier (P) or quay.

11 Claims, 7 Drawing Sheets

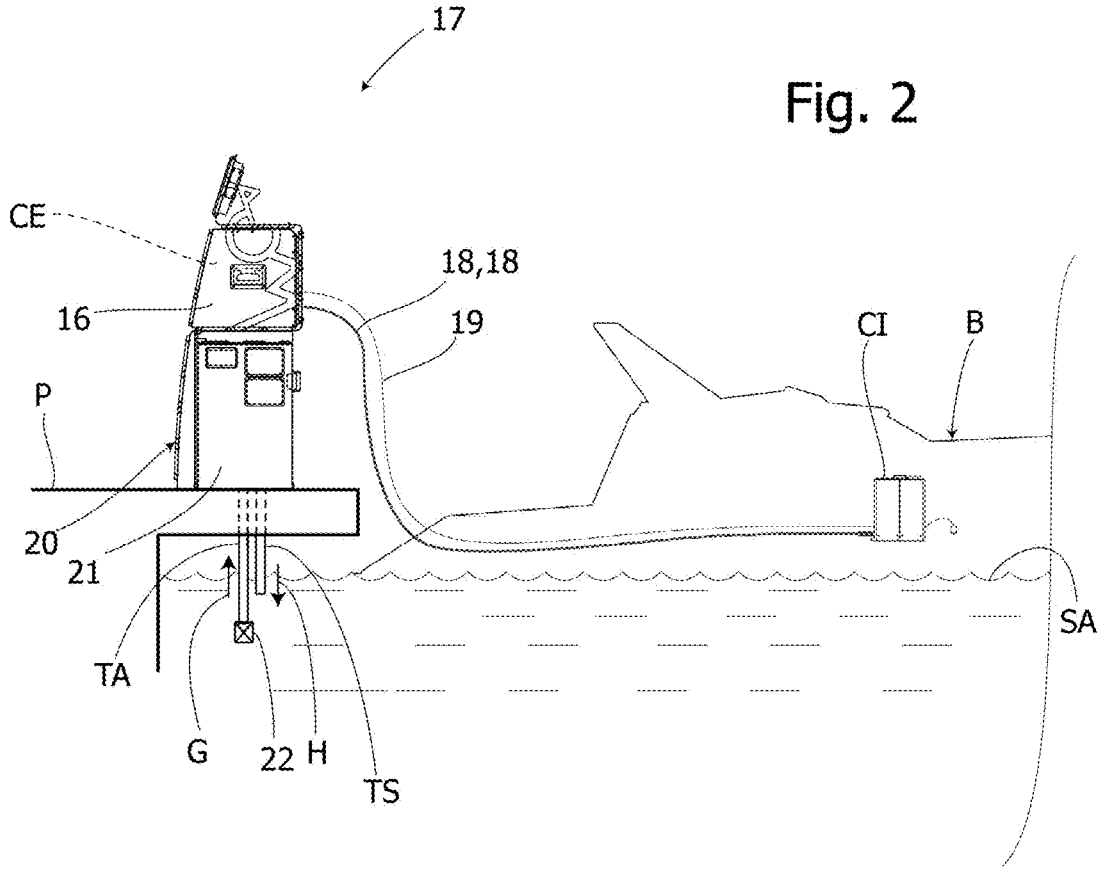
Fig. 2
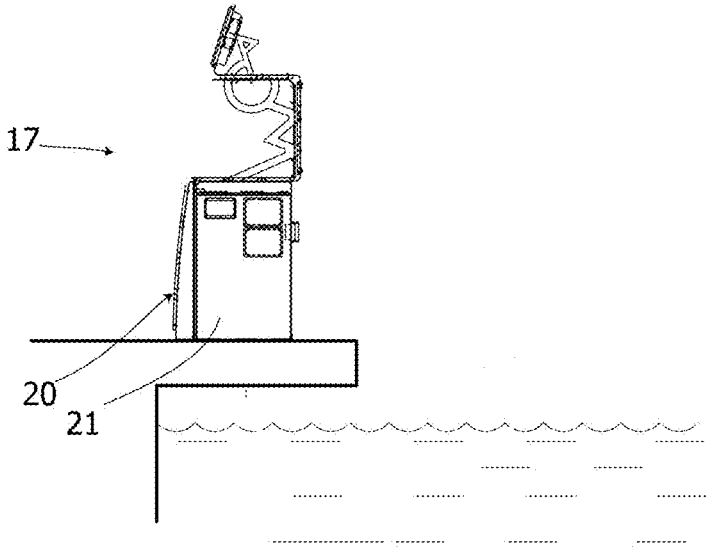

REFRIGERANT AIR CONDITIONER FOR BOATS IN PORTS AND MARINAS

FIELD OF THE INVENTION

The present invention relates to a refrigerant air conditioner for boats in ports and marinas. Such a refrigerant air conditioner is inserted in a pedestal that can be used also in camping areas for recreational vehicles and temporary shelters.

PRIOR ART

The International Patent Application PCT/IB2014/061551 of the same Applicant discloses a multi-service pedestal, in particular for ports and marinas, being provided with a support structure and adapted to supply a variety of utilities, such as electricity, tap water, telephone and television connections, to a boat moored at a pier or quay.

The multi-service pedestal further has a central conditioning apparatus adapted to be connected to a terminal unit onboard the moored boat for conditioning the air within it by heat exchange with a conditioning liquid.

In the above mentioned patent application the central conditioning apparatus that is a machine acting as a chiller or as a heat pump depending on the direction of the refrigerant or operating fluid in a flow circuit of the same machine includes an open loop heat exchanger for exchanging heat between the operating fluid and cooling water being sucked for example from a basin near the multi-service pedestal, and a closed loop heat exchanger for exchanging heat between the operating fluid and a conditioning liquid. The terminal unit is a fan coil for the conditioning liquid that is connected to the closed loop heat exchanger by delivery pipes and return pipes.

The multi-service pedestal according to the patent application above mentioned succeed to overcome the problem of providing conditioned air to a moored boat without air conditioner. However, the multi-service pedestal above mentioned has a conditioning system that requires multiple heat exchanges: a first between the operating fluid and the external water, a second between operating fluid and conditioning liquid, a third between conditioning liquid and air of the room to be conditioned. These heat exchanges imply a rather complex conditioning system, a great number of components and then a high cost.

The present invention aims to overcome the above drawbacks.

A main object of the present invention is to provide a simple and cheap refrigerant air conditioner for boats in ports and marinas by virtue of a reduced number of components.

Another object of the invention is to provide an air conditioner able to operate for warming and chilling boats in a simple way with reduced operating and maintenance costs.

SUMMARY OF THE INVENTION

In order to achieve the objects above mentioned, the present invention, as defined in claim 1 enclosed to the present description, provides a refrigerant air conditioner for boats in ports and marinas, comprising a compressor, an external heat exchanger, a room heat exchanger cooperating with a fan, wherein the compressor and the external heat exchanger are contained within an air conditioner container forming part of a multi-service pedestal, equipped with a support structure situated on a pier or quay, and the internal heat exchanger is placed in a boat moored to the pier or quay.

Advantageously, the invention makes a simple, reliable and cheap air conditioner available to a user. The user has only to host onboard an internal heat exchanger connected to the other components of the conditioning system that are located in the container on the multi-service pedestal on the quay or pier, by a hose acting as a sheath that contains two other pipes for the refrigerant, i.e. a delivery pipe and a return pipe.

BRIEF DESCRIPTION OF THE DRAWINGS

Further features and advantages of the invention will be more evident from the description of embodiments of the present air conditioner, depicted by way of indicative and not limiting examples in the accompanying drawings in which:

FIG. 2 is a diagrammatic side view of a first installation example for the refrigerant air conditioner in FIG. 1, whose external components are in a container inserted in a multi-service pedestal, mounted on a pier, and the internal components are on a moored boat;

DESCRIPTION OF EMBODIMENTS OF THE INVENTION

Figure 1:
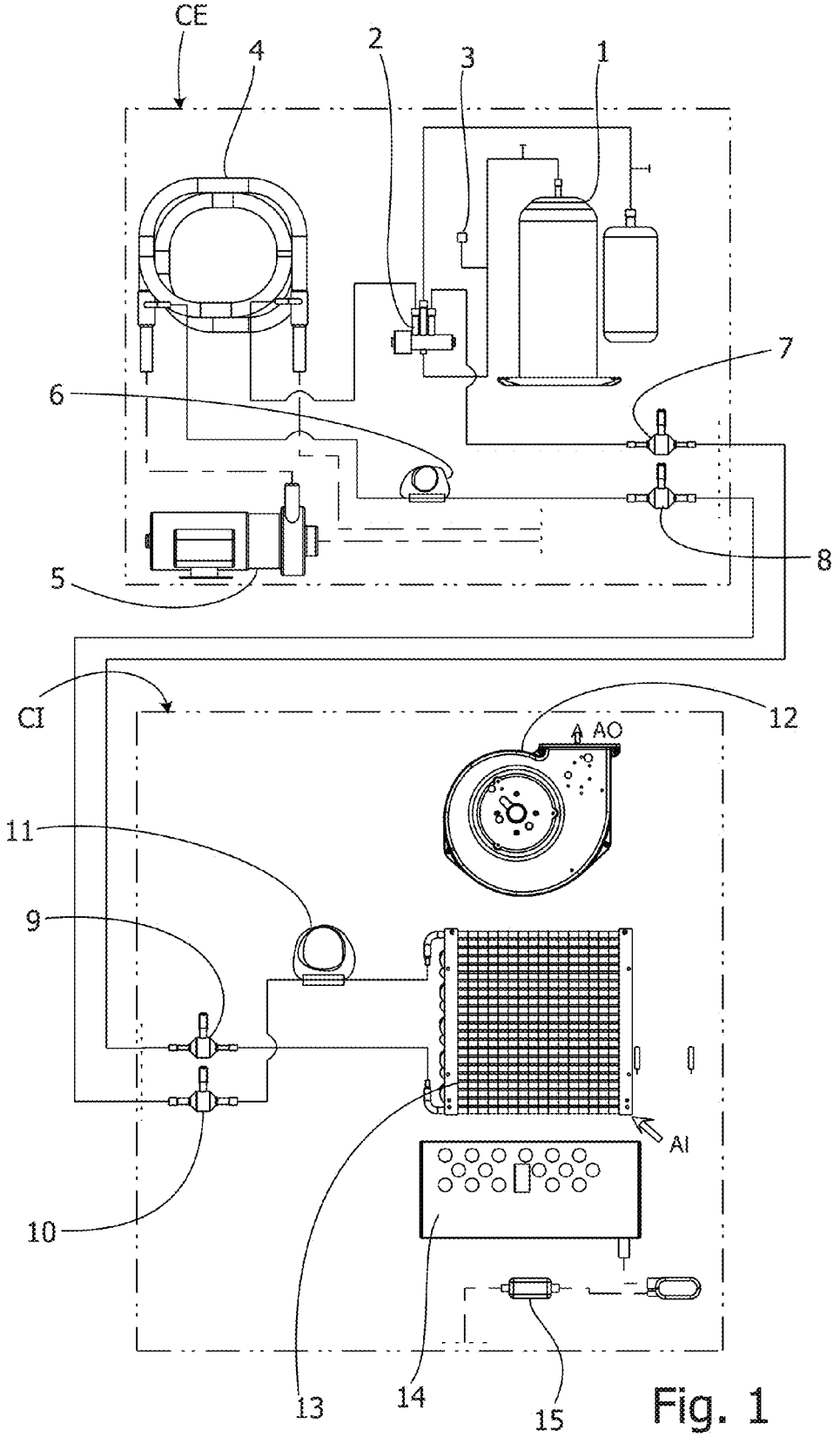
FIG. 1 is a schematic representation of the refrigerant air conditioner according to the invention whose main external and internal components are shown superiorly and inferiorly, respectively.

Reference is made initially to FIG. 1 that is a schematic representation of the refrigerant air conditioner according to the invention; particularly a flow chart for the refrigerant and the cooling water are shown. Main external and internal components of the air conditioner are shown superiorly and inferiorly, respectively. The internal components are those inside the room to be conditioned.

The external components CE comprise a compressor 1, a four-way valve 2, a pressure switch 3, an external heat exchanger 4, an intake pump 5, a no-return valve 6, external solenoid valves 7, 8. The internal components CI comprise internal solenoid valves 9, 10, an internal check valve 11, a fan 12, an internal heat exchanger 13, a small collecting tank 14 and a drainage pump 15.

Pipes for refrigerant flow are depicted as single continuous lines, and the pipes for the water flow are represented with single dashed lines; single continuous lines and single dashed lines are not denoted with numeral references.

The external heat exchanger 4 is an open loop heat exchanger in which the pipe of refrigerant or operating fluid, represented with single continuous line, comes from the compressor 1 through the four-way valve 2 and exits the external heat exchanger 4 toward the no-return valve 6.

Cooling water comes from an adjacent water basin through a pipe, represented with single dashed line, by the intake pump 5, passes through the external heat exchanger 4 and exits it for returning into the water basin.

The solenoid valves 7, 8 separate the external components CE of the conditioner from the connections to the internal components CI having the solenoid valves 9, 10, similar to the solenoid valves 7, 8, the check valve 11 and the internal heat exchanger 13 that is provided with the fan 12 for conditioning the room in which it is placed.

Reference is made now to FIG. 2 that is a diagrammatic side view of a first installation example for the refrigerant air conditioner in FIG. 1. Its external components CE above described are in a container 16 inserted in a multi-service pedestal 17 mounted on a pier P. The internal components CI are on a moored boat B. The connection between the components CE and the components CI is made through two refrigerant delivery and return pipes 18, 18, respectively, and an electric connection line 19 between inside and outside. The electric connection line 19 allows the conditioner to be operated by a not shown thermostat, situated inside the moored boat B.

The multi-service pedestal 17 has a support structure 20 with a substantially inverted squared S-shaped profile, if an upward inclined extension, as described below, is ignored. Placed in the upper part of the support structure 20 is the container 16 inside which are the external components CE of the air conditioner. A housing 21 for a group of utilities is removably placed on the L-shaped lower part of the support structure 20.

When the container 16 is inside the pedestal 17, as shown in FIG. 2, the air conditioner can work for conditioning air inside the boat B. The external heat exchanger 4, as shown in FIG. 1, has a thermal exchange with the water basin SA, whose sucked cooling water passes through a filter 22.

The arrow G, pointing upwards, indicates the direction of the cooling water flow in an intake pipe TA. The arrow H, pointing towards the water basin SA indicates the direction of the cooling water flow after cooling in a discharge pipe TS. It can be noted that the intake pipe TA and the discharge pipe TS, by passing inside the support structure 20, put in communication the open loop external heat exchanger 4 with the water basin SA.

Figure 3:
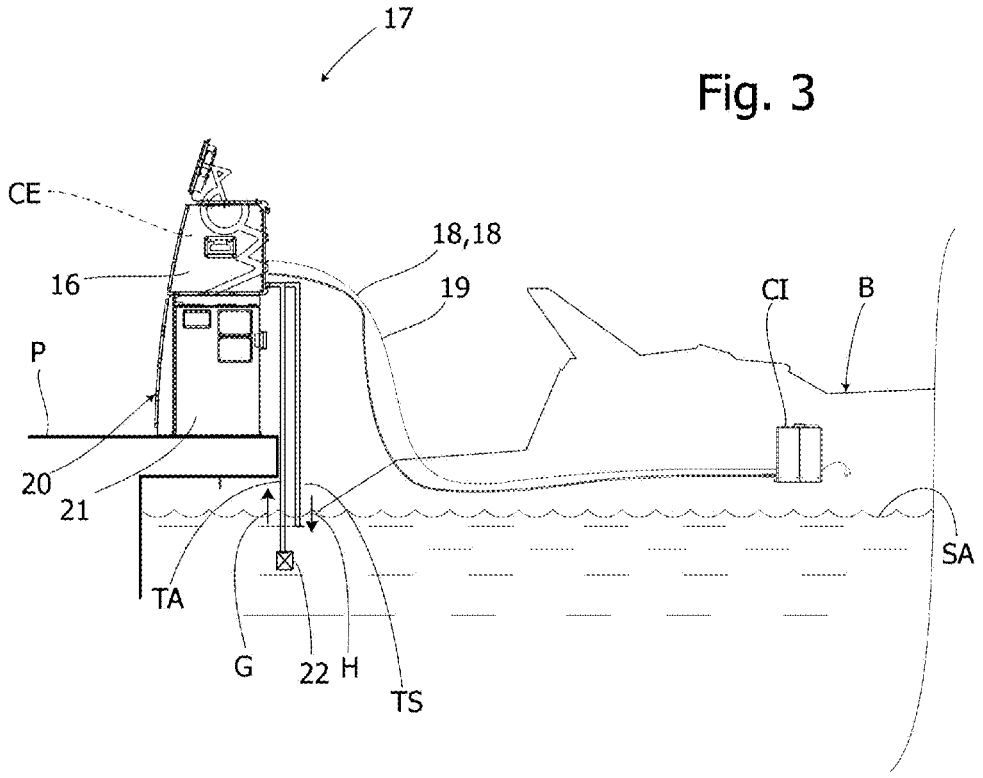
FIG. 3 is a diagrammatic side view of a second installation example for the refrigerant air conditioner similar to that in FIG. 2.
Figure 4:
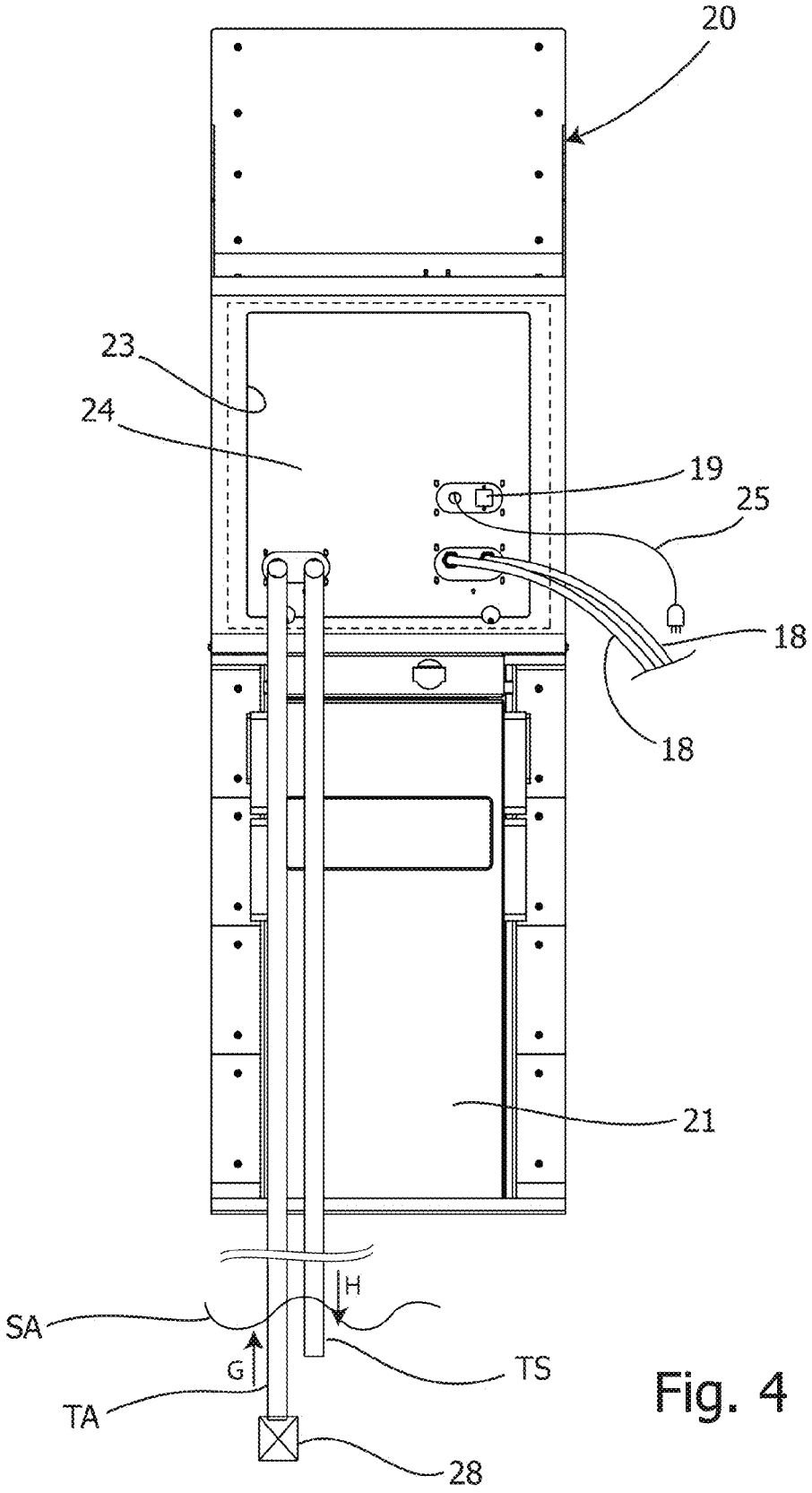
FIG. 4 is an enlarged rear view of the multi-service pedestal in the second installation example in FIG. 3.

Alternatively the intake pipe TA and the discharge pipe TS can pass outside the support structure 20. This is shown in FIG. 3 that is a diagrammatic side view of a second installation example for the refrigerant air conditioner similar to the first example shown in FIG. 2. Identical or similar parts are indicated with the same numerals. The second installation example differs from the first because the intake pipe TA and the discharge pipe TS exit laterally the pedestal 17, in particular from the rear of the container 16 of the air conditioner. This is shown in more detail in FIG. 4 that is an enlarged rear view of the multi-service pedestal in the second installation example of the air conditioner according to the present invention. The support structure 20 shows behind a cutout 23 in order to permit the passage of pipes and connections from a rear side 24 of the container 16 of the air conditioner. The intake pipe TA and the discharge pipe TS of the cooling water, as well as the delivery and return pipes 18, 18 of the refrigerant and the electric connection line 19, pass through the cutout 23, that can be closed with a removable panel as shown in the following. Indicated as 25 on the rear side of the container 16 is a power cord of the conditioning system.

Figure 6:
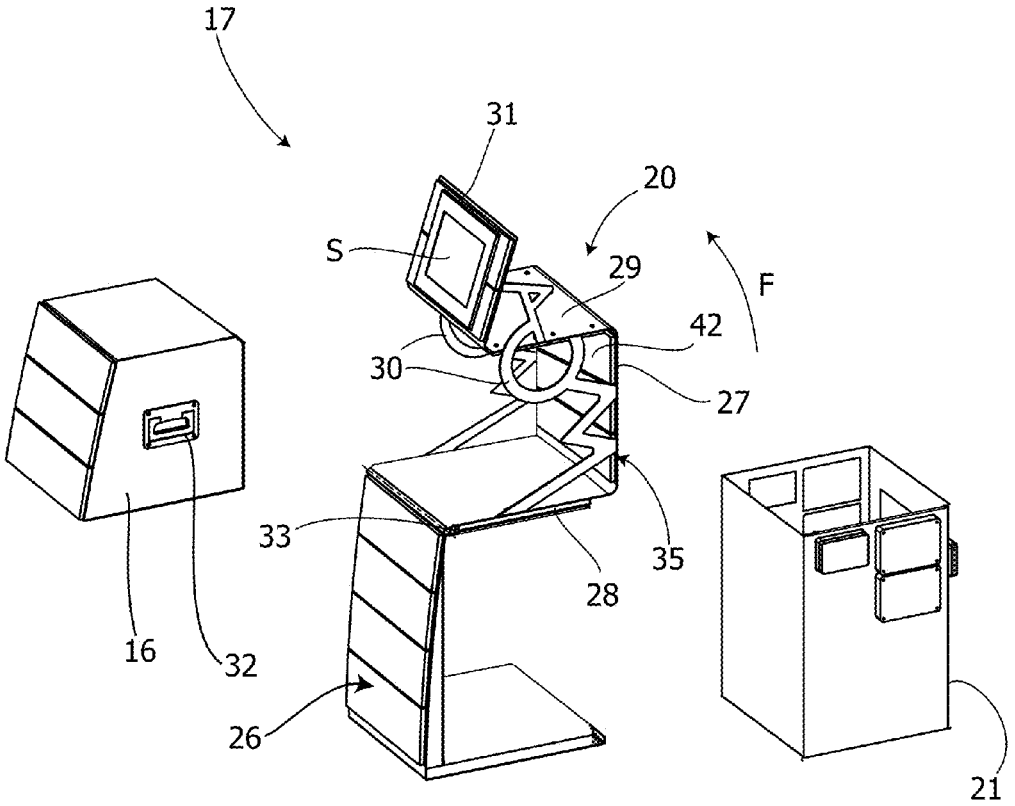
FIG. 6 is an exploded perspective view of the multi-service pedestal shown in FIGS. 2 and 3.

The pedestal 17 is best shown in FIG. 6 that is an exploded perspective view of the multi-service pedestal 17 represented in FIG. 2. The squared S-shaped profile is formed by an L-shaped lower part and by an inverted C-shaped upper part 35 with a vertical side 27 and parallel sides 28, 29. Support elements 30 between these parallel sides 28, 29 serve to stiffen the inverted C-shaped upper part 35. The support elements 30 shaped as a logo, for example distinctive of the port or marina that use the multi-service pedestal. However, it should be evident that such support elements 30 can have an anonymous form like simple bars.

The inverted C-shaped upper part 35 extends upwards in a portion 31 inclined backward in order to sustain, advantageously, a computer display S. As shown in the figures, the support element 30 extends from the upper part 35 to the portion 31 inclined backward. The inverted C-shaped upper part 35 is intended to receive removable in the inverted C-shaped recess the container 16, which is suitably retained and blocked. The container 16 has side grip handles 32, and is frontally coated with slats of wood or composite material like other front parts of the support structure 20. Among these, there is a closure panel 42 of the cutout 23 (shown in FIG. 4), which is aesthetically useful for the support structure 20 when the container 16 is removed from the upper part 35 of the support structure 20.

The inverted C-shaped upper part 35 can be connected with cylindrical hinges 33 to the inverted L-shaped lower part 26, as shown in FIG. 6. After the removal of the container 16, the upper part 35 can rotate around the hinges 33 in the direction shown by the arrow F in FIG. 6. As a result of this rotation, the container 21 can be received for the multi-service pedestal utilities in the inverted L-shaped lower part 26. The utility container 21 is retained in position by the upper part 35 that has on the horizontal side 28 a covering element (not denoted with a numeral reference) intended to position itself on the utility container 21 and to block it when the upper part 35 is in an operating position as shown in FIG. 3. The utility container as well as the utilities themselves right inside are not illustrated, nor described in more detail as generally known, insofar as typical of the pedestals for ports and marinas.

Figure 5:
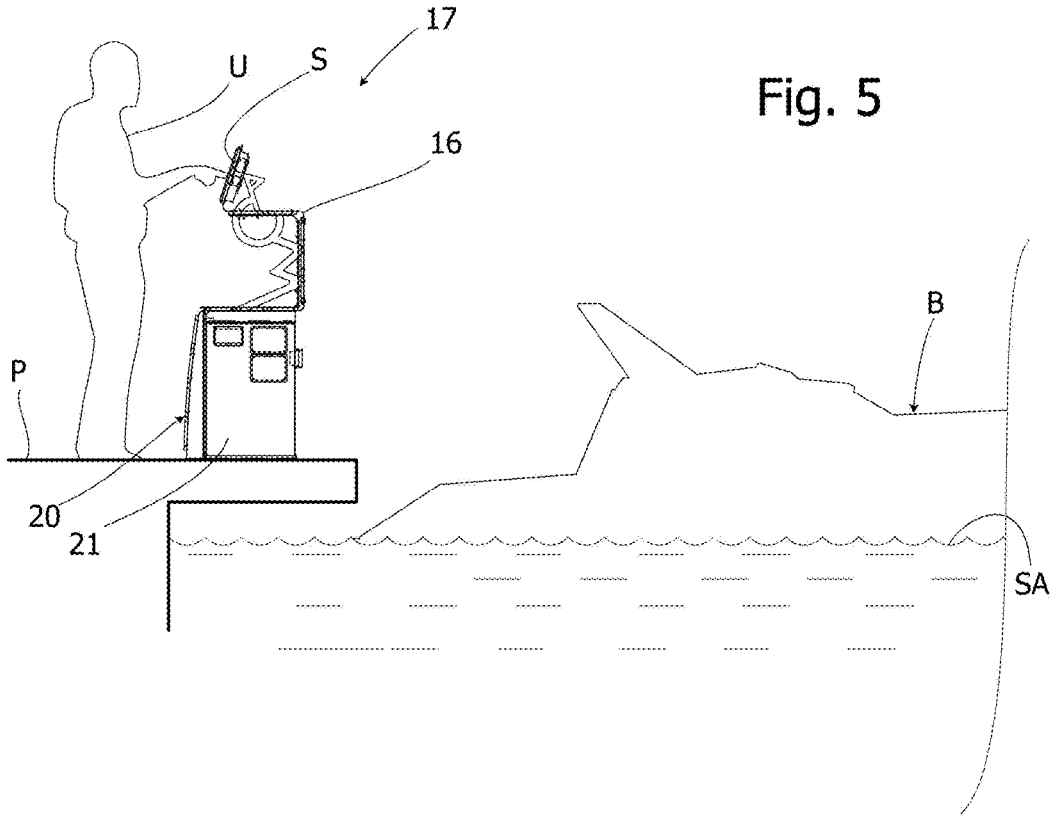
FIG. 5 is a diagrammatic side view of a third installation example without the refrigerant air conditioner.

With regards to that, reference is made to FIG. 5, which is a diagrammatic side view of a third installation example of a multi-service pedestal without the refrigerant air conditioner. In this figure it can be seen that the air conditioner container, as well as the cooling water intake and discharge pipes, the internal cooling system components, the delivery and return pipes of the refrigerant and the electric connection line between the external and internal components of the cooling system, has been removed.

A user U is shown at the computer display of the multi-service pedestal 17. The display S, which can be a touch screen display, can be used in order to receive weather and marine forecast, and any other service information or advertising.

The display, placed on the surface of the portion 31 inclined backwards in order to obtain an optimal vision, through cable or Wi-Fi connections, allows the user to benefit from an interacting dedicated service promotion, as well as an advertising program.

Figure 7:
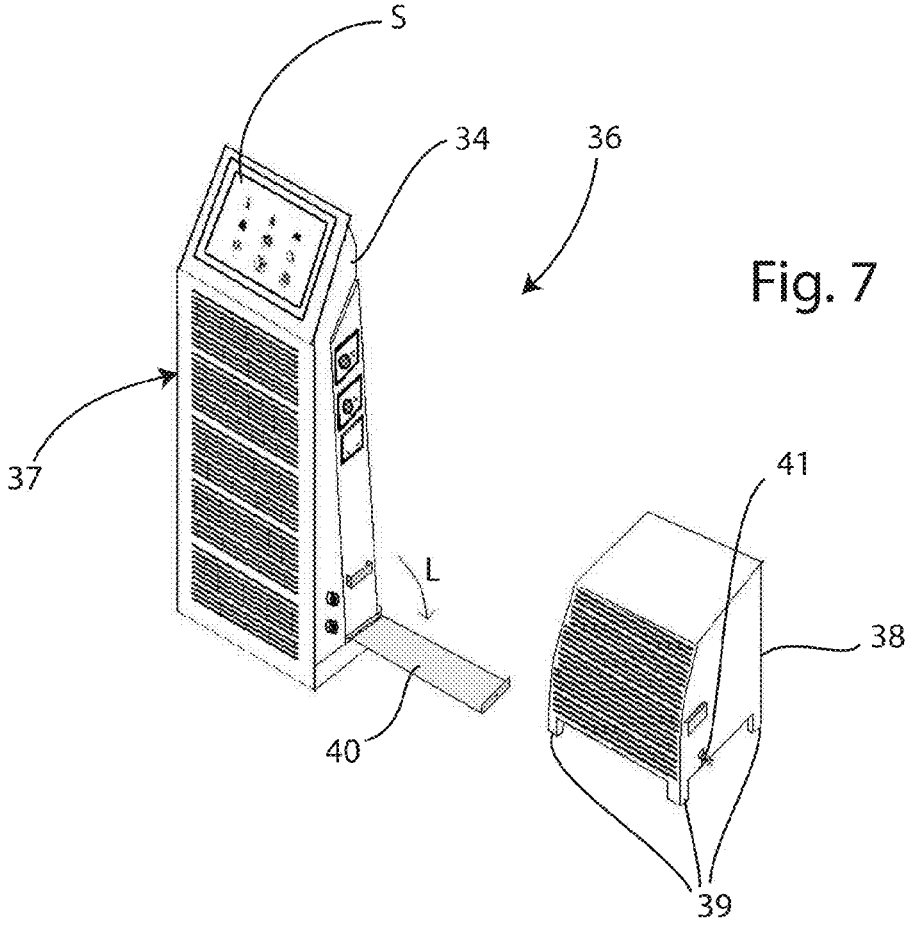
FIGS. 7 and 8 are a perspective view of a variant of the multi-service pedestal with a conditioner container that is detached and connected, respectively, to the multi-service pedestal.

Reference is made now to FIGS. 7 e 8, which are a perspective view of a variant of the multi-service pedestal with a conditioner container that is detached and connected, respectively, to the multi-service pedestal.

A multi-service pedestal 36 has a substantially prismatic shaped support structure 37 that ends superiously with an inclined plane 34 sustaining a display S. The external components of the air conditioner according to the present invention are inside a container 38 provided with small feet 39 in order to lie on the ground near the support structure 37. The support structure 37 is provided with union means that connect the container 38 to the support structure 37. In an example the union means are in the form of a flip-open arm 40 that connects the cooling air conditioner container 38 to the support structure 37 by means of a lock 41.

Figure 8:
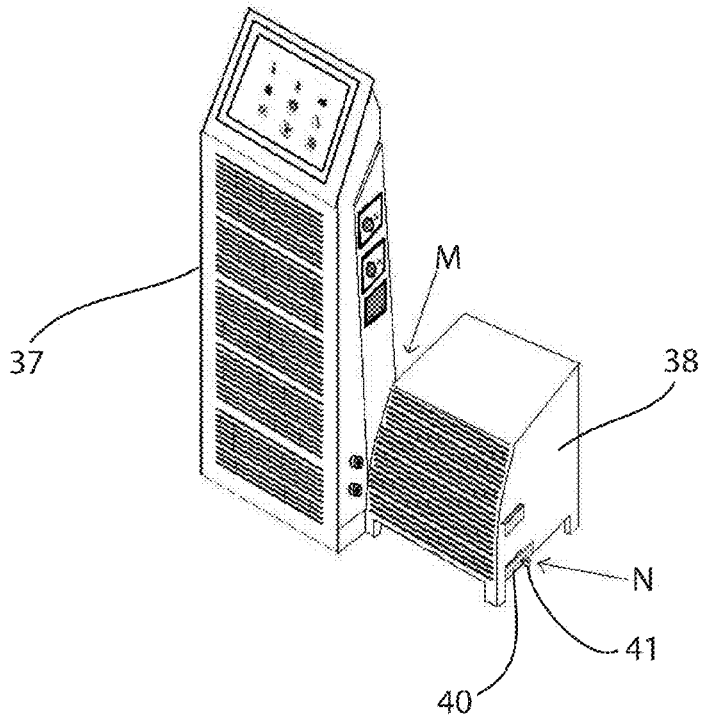

In FIG. 7 the container 38 is shown separated from the support structure 37, and the flip-open arm 40 is shown rotated in an arrow L direction until a horizontal position. In FIG. 8 the container 38 is put close to the support structure 37 in the position indicated by an arrow M, and an arrow N indicates the closure of the flip-open arm on the container 38 by means of the lock 41.

Evident are the advantages of the present invention, consisting in a combination of a multi-service pedestal for ports and marinas and of an air conditioning system. The multi-service pedestal supplies chilled and warmed air to the inside of boats that have no fixed air conditioner onboard due to dimensions or cost thereof.

The operation of the air conditioner according to the present invention is similar in both the example of multi-service pedestal shown in FIGS. 2 to 6, where the multi-service pedestal 17 has an air conditioner container 16 inserted advantageously removably inside the support structure 20, and that one shown in FIGS. 7 and 8, where the multi-service pedestal 36 has an air conditioner container 38 connectable to the side of the support structure 37.

When a boat B requests an air conditioning inside, the air conditioner container 16 or 38 is inserted or put close, respectively, to the support structure 20 or 37 and connected to the above described pipes. These pipes connect the external heat exchanger with the cooling water of the surrounding basin in the case of a hydraulic cooling and connect the external components of the air conditioner with the internal components of the boat. A regulation of temperature inside the boat is accomplished through a thermostat that is a component internal to the boat, being connected by an electric connection line to the external components inside the container 16 or 38.

It can be understood that the prefixed objects have been achieved; first of all, the object of providing a refrigerant air conditioner for boats in ports and marinas that is simple and cheap, in virtue of a reduced number of components, able to operate for warming and chilling boats in a simple way, with reduced operating and maintenance costs.

If the external heat exchanger was air cooled, the refrigerant air conditioner according to the invention could be used also in camping grounds for leisure vehicles and provisional shelters.

What is claimed is:

1. A refrigerant air conditioner for boats in ports and marinas, comprising:

a multi-service pedestal (17) comprising a support structure (20) mounted on a pier or on a quay;

an air conditioner container (16) removably located in the multi-service pedestal and housing external components (CE) of the refrigerant air conditioner, the air conditioner container housing a compressor (1) and an open-loop heat exchanger (4) cooled by water from an adjacent water basin, the compressor operatively connected to the open-loop heat exchanger, wherein the air conditioner container (16) further includes a power cord (25) for connection to the multi-service pedestal (17) for the multi-service pedestal (17) providing power to the refrigerant air conditioner, the air conditioner container (16) being adapted to be removably received in a first multi-service pedestal (17) at a first location at the pier or on the quay to allow the air conditioner container (16) for providing air conditioning to a first boat, and to be moved to a second multi-service pedestal (17) at a second location at the pier or on the quay for providing air conditioning to a second boat;

an internal assembly (CI) of the refrigerant air conditioner configured for placement within a room to be conditioned within a selected one of the first boat moored to the pier or to the quay at the first location and the second boat moored to the pier or to the quay at the second location, the internal assembly (CI) including a room heat exchanger (13) cooperating with a fan (12) that cools the room to be conditioned within the boat; and refrigerant delivery and return pipes (18, 18) that extend through the air conditioner container (16) to the internal assembly (CI), the refrigerant delivery and return pipes (18, 18) extending from a refrigerant outlet of the air conditioner container to a refrigerant inlet of the room heat exchanger (13) and from a refrigerant outlet of the room heat exchanger (13) to a refrigerant inlet of the air conditioner container.

2. The refrigerant air conditioner according to claim 1, further comprising:

a cooling water intake pump housed within the air conditioner container;

an intake pipe (TA) that provides water to the cooling water intake pump, the intake pipe extending from the water basin and connected to the air conditioner container; and a discharge pipe (TS) that discharges water from an outlet of the open-loop heat exchanger (4) to the water basin, the discharge pipe being connected to the air conditioner container.

3. The refrigerant air conditioner according to claim 2, wherein the intake pipe and the discharge pipe are put in communication the open-loop heat exchanger with the water basin by passing inside the support structure.

4. The refrigerant air conditioner according to claim 2, wherein, the intake pipe and the discharge pipe are put in communication the open-loop heat exchanger with the water basin by passing outside of the support structure.

5. The refrigerant air conditioner according to claim 1, wherein the multi-service pedestal is provided with a support structure provided with joining means connecting the air conditioner container to the support structure.

6. The refrigerant air conditioner according to claim 1, further comprising an electric connection line (19) that extends from the air conditioner container (16) to the internal assembly (CI).

7. The refrigerant air conditioner according to claim 1, wherein the multi-service pedestal is adapted to provide a plurality of utilities, including electricity, drinking water, telephone and television connections.

8. The refrigerant air conditioner according to claim 1, wherein the support structure has a squared S-shaped profile extending upwards in a backward inclined portion to receive a computer screen, the squared S-shaped profile comprising an inverted C-shaped upper part intended to removably receive the air conditioner container, and an L-shaped lower part adapted to receive a group of utilities.

9. The refrigerant air conditioner according to claim 8, wherein the inverted C-shaped upper part is articulated by cylindrical hinges to the L-shaped lower part, so that a housing for a group of utilities is removably placed on the L-shaped lower part, the housing for a group of utilities being capable of being removed from the multi-service pedestal by turning up the inverted C-shaped upper part, after that the air conditioner container has been removed from the inverted C-shaped upper part.

10. The refrigerant air conditioner according to claim 5, wherein joining means comprise a flip-open arm retaining the air conditioner container equipped with feet for resting on the ground close to the support structure.

11. A refrigerant air conditioner for boats in ports and marinas, comprising:

a multi-service pedestal (17) comprising a support structure (20) mounted on a pier or on a quay;

an air conditioner container (16) removably mounted to in the multi-service pedestal, the air conditioner container (16) housing external components (CE) of the refrigerant air conditioner, the external components (CE) of the refrigerant air conditioner housed in the air conditioner container including a compressor (1), an external, open-loop heat exchanger (4) cooled by water from an adjacent water basin, and a water intake pump (5) that provides the water from the adjacent water basin to cool the open-loop heat exchanger (4), the compressor operatively connected to the external heat exchanger, the air conditioner container including a power cord (25) for connection to the multi-service pedestal (17) for the multi-service pedestal (17) providing power to the refrigerant air conditioner, the air conditioner container (16) being adapted to be removably received in a first multi-service pedestal (17) at a first location at the pier or on the quay to allow the air conditioner container (16) for providing air conditioning to a first boat, and to be moved to a second multi-service pedestal (17) at a second location at the pier or on the quay for providing air conditioning to a second boat;

a portable internal assembly (CI) of the refrigerant air conditioner configured for placement within a room to be conditioned within a selected one of the first boat moored to the pier or to the quay at the first location and the second boat moored to the pier or to the quay at the second location, the internal assembly (CI) including a room heat exchanger (13) cooperating with a fan (12) that cools the room to be conditioned within the boat;

refrigerant delivery and return pipes (18, 18) that extend through the air conditioner container (16) to the internal assembly (CI), the refrigerant delivery and return pipes (18, 18) extending from a refrigerant outlet of the air conditioner container to a refrigerant inlet of the room heat exchanger (13) and from a refrigerant outlet of the room heat exchanger (4) to a refrigerant inlet of the air conditioner container.

* * * * *